US006537032B1

(12) United States Patent
Horiuchi et al.

(10) Patent No.: US 6,537,032 B1
(45) Date of Patent: Mar. 25, 2003

(54) LOAD DEPENDENT VARIABLE SPEED HYDRAULIC UNIT

(75) Inventors: Hitoshi Horiuchi, Settsu (JP); Jun Nakatsuji, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/856,664

(22) PCT Filed: Sep. 14, 2000

(86) PCT No.: PCT/JP00/06299

§ 371 (c)(1),
(2), (4) Date: May 24, 2001

(87) PCT Pub. No.: WO01/21959

PCT Pub. Date: Mar. 29, 2001

(30) Foreign Application Priority Data

Sep. 24, 1999 (JP) ..... 11-270264

(51) Int. Cl.[7] ..... F04B 49/00; F04B 49/06

(52) U.S. Cl. ..... 417/18; 417/122; 417/42; 417/44.11; 417/44.2

(58) Field of Search ..... 417/18, 22, 42, 417/44.11, 48.2, 43

(56) References Cited

U.S. PATENT DOCUMENTS

| | | | | | |
|---|---|---|---|---|---|
| 3,966,358 | A | * | 6/1976 | Heimes et al. | 417/12 |
| 4,225,290 | A | * | 9/1980 | Allington | 318/48 |
| 4,474,104 | A | * | 10/1984 | Creffield | 417/18 |
| 4,595,495 | A | * | 6/1986 | Yotam et al. | 210/101 |
| 4,617,637 | A | * | 10/1986 | Chu et al. | 128/204.21 |
| 4,795,314 | A | * | 1/1989 | Prybella et al. | 417/43 |
| 4,850,805 | A | * | 7/1989 | Madsen et al. | 222/63 |
| 5,240,380 | A | * | 8/1993 | Mabe | 417/43 |

FOREIGN PATENT DOCUMENTS

| | | |
|---|---|---|
| JP | A60184994 | 9/1985 |
| JP | A2213640 | 8/1990 |
| JP | A5196001 | 8/1993 |
| JP | A7337072 | 12/1995 |
| JP | A10131866 | 5/1998 |
| JP | A11159465 | 6/1999 |
| JP | A11210635 | 8/1999 |

* cited by examiner

*Primary Examiner*—Cheryl J. Tyler
*Assistant Examiner*—Timothy P. Solak
(74) *Attorney, Agent, or Firm*—Birch, Stewart, Kolasch & Birch, LLP

(57) ABSTRACT

There is provided an autonomous inverter-driven hydraulic unit in which a command pressure and command flow rate do not need to be inputted from outside and a pressure and flow rate can be autonomously controlled without requiring any input signal wire. A target horsepower calculation unit 25 of a controller 11 judges which of a plurality of regions a point representing a present operating state belongs to and calculates a target horsepower represented by a point on a target pressure-flow rate characteristic line based on the present pressure and present flow rate. A comparison unit 28 calculates a deviation of this target horsepower and a present horsepower received from a present horsepower calculation unit 26, inputs a control signal representing this deviation to the inverter 3 and controls a rotational number of a variable-speed motor 2 so that the present horsepower coincides with the target horsepower.

4 Claims, 2 Drawing Sheets

LOAD DEPENDENT VARIABLE SPEED HYDRAULIC UNIT

This application is the national phase under 35 U.S.C. §371 of PCT International Application No. PCT/JP00/06299 which has an International filing date of Sep. 14, 2000, which designated the United States of America and was not published in English.

TECHNICAL FIELD

The present invention relates to a hydraulic unit in which a hydraulic pump is driven by a variable-speed motor driven by an inverter.

BACKGROUND ART

Conventionally, there is a hydraulic unit in which a servomotor for driving a hydraulic pump is controlled in response to operation of an actuator, by a pressure control signal representing a deviation of a pressure command signal inputted from outside (main unit side) and a pressure signal representing a discharge pressure of the hydraulic pump detected by a pressure sensor at the time of pressure control while controlled by a flow rate control signal representing a deviation of a flow rate command signal inputted from outside and a rotation speed signal of the servomotor equivalent to a flow rate detected by a rotation sensor at the time of flow rate control (Japanese Patent Laid-Open Publication No. 5-196001).

However, since input signal wires are required to input the pressure command signal and flow rate command signal from outside in the conventional hydraulic unit, a problem arises that the surrounding of the hydraulic unit becomes disorderly with these input signal wires and a power wire.

DISCLOSURE OF THE INVENTION

Accordingly, an object of the present invention is to provide a hydraulic unit which does not require input signal wires connected from outside.

To attain the above-described object, the autonomous inverter-driven hydraulic unit of the present invention comprises:

- a hydraulic pump;
- a variable-speed motor for driving the hydraulic pump;
- an inverter for driving the variable-speed motor;
- a load sensor for detecting a load of the hydraulic pump;
- a rotation sensor for detecting a rotation speed of the variable-speed motor or hydraulic pump; and
- a controller for outputting a control signal to the inverter based on outputs from the load sensor and rotation sensor so that a pressure and flow rate of fluid discharged from the hydraulic pump become a pressure and flow rate on a predetermined target pressure-flow rate characteristic line.

According to the above constitution, the controller outputs the control signal to the inverter based on the outputs from the load sensor and rotation sensor without receiving a pressure command signal or flow rate command signal from outside so that a pressure and flow rate of fluid discharged from the hydraulic pump become a pressure and flow rate on the predetermined target pressure-flow rate characteristic line. Thus, this autonomous inverter-driven hydraulic unit controls the rotational number of the variable-speed motor by the controller autonomously via the inverter to control the pressure and flow rate of the fluid from the hydraulic pump without receiving a pressure command signal or flow rate command signal from outside. Therefore, input signals wire can be omitted and no human operation for inputting these command signals is required since the pressure command signal and flow rate command signal do not need to be inputted from outside. Thus, wiring is simplified.

In one embodiment, the target pressure-flow rate characteristic line is composed of a maximum flow rate line, maximum horsepower curve or about maximum horsepower line, and maximum pressure line.

According to the above constitution, for example, at the time of pressure keeping, the controller rotates the variable-speed motor via the inverter so that the hydraulic pump discharges at a low flow rate represented by a point on a maximum pressure line substantially in parallel to a flow rate axis. Therefore, since the variable-speed motor and hydraulic pump do not rotate at a rotation speed higher than necessary, energy saving can be achieved with little horsepower loss and noises can be reduced. Also, when no pressure is required, the controller rotates the variable-speed motor via the inverter so that a discharge pressure of the hydraulic pump becomes a low pressure represented by a point on a maximum flow rate line substantially in parallel to a pressure axis. Therefore, since the variable-speed motor and hydraulic pump do not rotate at a rotation speed higher than necessary, energy saving can be achieved with little horsepower loss and noises can be reduced. When a maximum horsepower is required, the controller rotates the variable-speed motor via the inverter to obtain a value on the maximum horsepower curve or pseudo maximum horsepower line.

In one embodiment, the controller has a target horsepower calculation unit calculating a target horsepower based on the outputs from the load sensor and rotation sensor and the target pressure-flow rate characteristic line, a present horsepower calculation unit calculating a present horsepower based on the outputs from the load sensor and rotation sensor and a comparison unit comparing the target horsepower and the present horsepower and outputting the control signal to the inverter.

According to the above constitution, the target horsepower calculation unit of the controller calculates the target horsepower based on the outputs from the load sensor and rotation sensor and the target pressure-flow rate characteristic line without receiving a command signal from outside. On the other hand, the present horsepower calculation unit calculates the present horsepower based on the outputs of the load sensor and rotation sensor. Then, the comparison unit compares the target horsepower and the present horsepower and outputs a control signal to the inverter so that the present horsepower becomes the target horsepower. Thus, the flow rate and pressure of the fluid discharged from the hydraulic pump easily become values on the target pressure-flow rate characteristic line.

In one embodiment, the load sensor is a current sensor for detecting current flowing to the variable-speed motor.

According to the above constitution, since the load sensor is the current sensor for detecting current which flows to the variable-speed motor, the discharge pressure of the hydraulic pump can be easily detected.

In one embodiment, the load sensor is a pressure sensor for detecting a pressure in a discharge line of the hydraulic pump.

According to the above constitution, since the load sensor is the pressure sensor for detecting the pressure in the discharge line of the hydraulic pump, the pressure in the discharge line of the hydraulic pump can be detected directly and precisely.

BEST MODE FOR CARRYING OUT THE INVENTION

Figure 1:
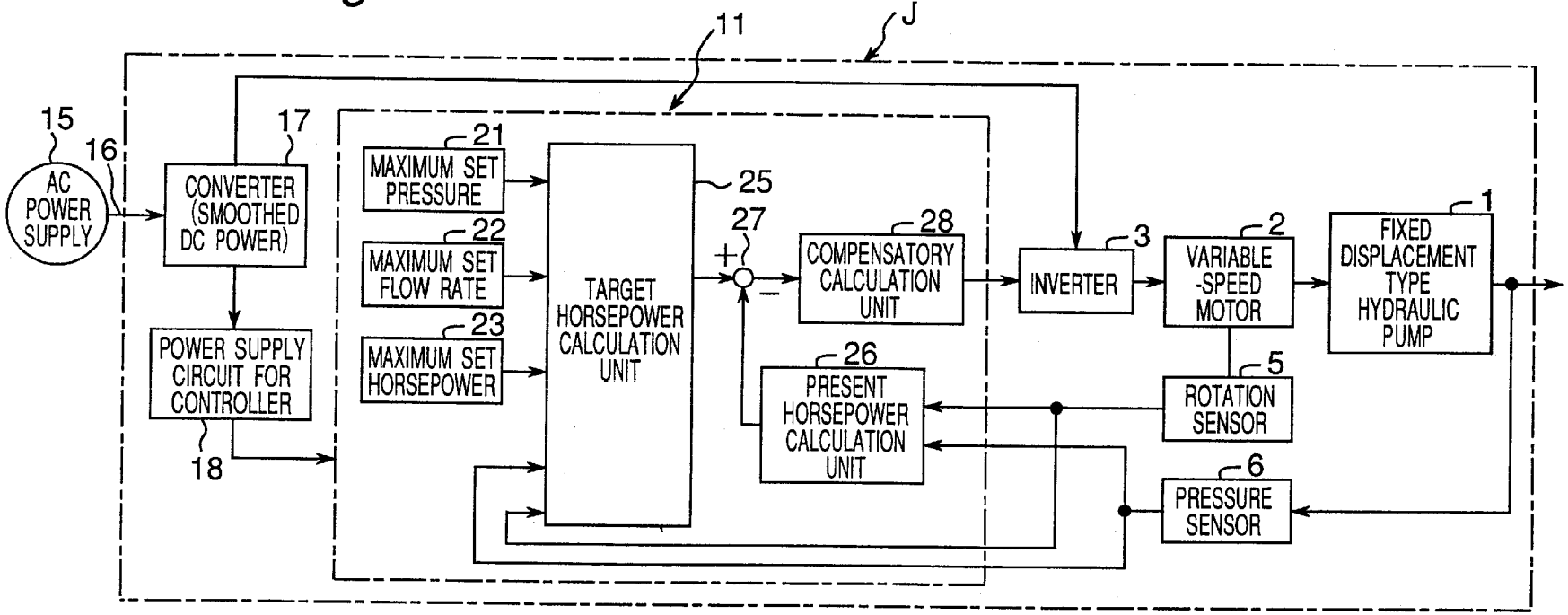
FIG. 1 is a block diagram showing an autonomous inverter-driven hydraulic unit according to one embodiment of the invention.

The present invention is described in detail below with reference to an embodiment shown in the drawing.

As shown in FIG. 1, in this autonomous inverter-driven hydraulic unit J, a fixed displacement type hydraulic pump 1 such as, for example, a gear pump, trochoide pump, vaned pump, piston pump or the like, is driven by a variable-speed motor 2 such as, for example, a switched reluctance motor, buried magnetic type motor (IPM) or the like, and this variable-speed motor 2 is driven by an inverter 3. A rotation speed of the variable-speed motor 2 corresponding to a discharge flow rate of the fixed displacement type hydraulic pump 1 is detected by a rotation sensor 5, and a pressure of fluid of the discharge line of the fixed displacement type hydraulic pump 1 is detected by a pressure sensor 6 as an example of a load sensor. The inverter 3 controls the number of revolutions of the fixed displacement type hydraulic pump 1 via the variable-speed motor 2 by controlling switching of transistors (not shown) by a control signal from a controller 11 receiving outputs from the rotation sensor 5 and pressure sensor 6. A flow rate command signal or pressure command signal from outside of this autonomous inverter-driven hydraulic unit J is not inputted to this controller 11, but the flow rate and pressure of the fixed displacement type hydraulic pump 1 are autonomously controlled based on outputs from the rotation sensor 5 and pressure sensor 6 as described later.

On the other hand, a power wire from an ac power supply (commercial power supply) 15 is connected to a power supply connecting terminal 16 to supply ac power to a converter 17. Smoothed dc power outputted from this converter 17 is supplied to the inverter 3 and to a power circuit 18 for the controller. This power circuit 18 for the controller reduces a voltage to, for example, 5V and supplies low-voltage dc power to the controller 11. The converter 17 and power circuit 18 for the controller constitute a power supply device.

Figure 2:
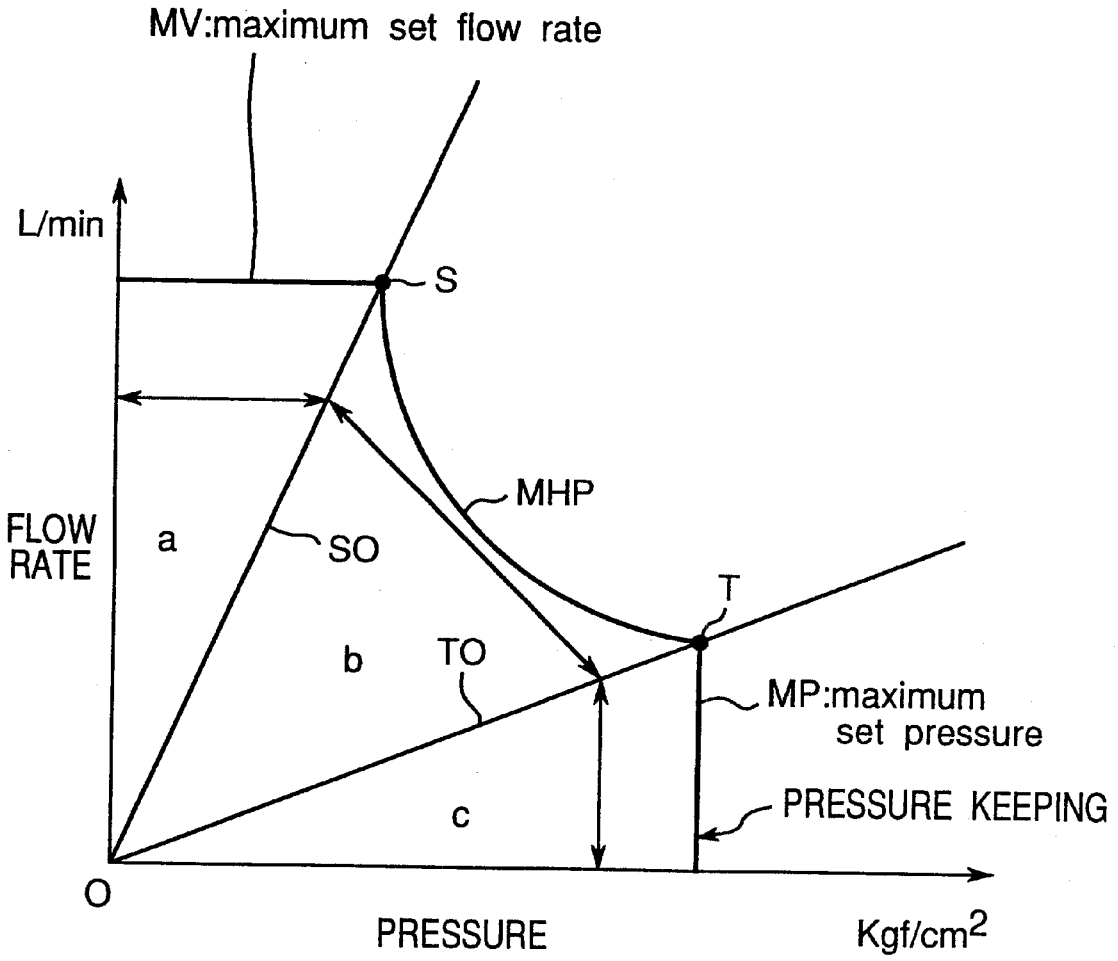
FIG. 2 is a target pressure-flow rate characteristic line drawing.

The controller 11 is composed of a microcomputer and has setting switches 21, 22, 23 as examples of setting means, a target horsepower calculation unit 25, present horsepower calculation unit 26, comparison unit 27 and compensatory calculation unit 28. A maximum set pressure, maximum set flow rate and maximum set horsepower are inputted to a storage unit (not shown) of the target horsepower calculation unit 25 in advance by using the setting switches 21, 22, 23, respectively. The target horsepower calculation unit 25 creates a target pressure-flow rate characteristic line shown in FIG. 2 (information equivalent thereto) based on the maximum set pressure, maximum set flow rate and maximum set horsepower and stores the line in the storage unit. As shown in FIG. 2, this target pressure-flow rate characteristic line is composed of a maximum flow rate line MV corresponding to a maximum set flow rate, a maximum horsepower curve MHP composed of a hyperbolic curve corresponding to a maximum set horsepower and a maximum pressure line MP corresponding to a maximum set pressure. The target horsepower calculation unit 25 also stores line SO connecting an intersection point S of the maximum flow rate line MV and maximum horsepower curve MHP and the origin O and line TO connecting an intersection point T of the maximum horsepower curve MHP and maximum pressure line MP and the origin O and defines a region a enclosed by the vertical axis (flow rate axis), maximum flow rate line MV and line SO, region b enclosed by lines SO, TO and the maximum horsepower curve MHP and region c enclosed by line TO, the maximum pressure line MP and. horizontal axis (pressure axis). Furthermore, the target horsepower calculation unit 25 receives the rotation speed inputted from the rotation sensor 5, that is, a signal representing the present flow rate and a signal representing the present pressure inputted from the pressure sensor 6 and can identify by calculation a region out of the aforementioned regions a, b, c to which a point in FIG. 2 represented by these present flow rate and present pressure, that is, a point (present pressure, present flow rate) representing the present operating state belongs to. This calculation determines on which side of the lines or curve defining borders of regions a, b, c the point (present pressure, present flow rate) is located and a coordinate of the point (present pressure, present flow rate) is substituted in expressions of the lines or curve to see whether the value is positive or negative.

Furthermore, the target horsepower calculation unit 25 calculates a target horsepower in respective regions a, b, c as follows and outputs the target horsepower to the comparison unit 27;

$$\text{Target horsepower} = \text{maximum set flow rate MV} \times \text{present pressure}$$

when a point (present pressure, present flow rate) representing the present operating state represented as the present flow rate and present pressure in FIG. 2 belongs to the aforementioned region a, $$\text{Target horsepower} = \text{maximum set horsepower}$$

when a point (present pressure, present flow rate) representing the present operating state represented as the present flow rate and present pressure in FIG. 2 belongs to the aforementioned region b, and $$\text{Target horsepower} = \text{maximum set pressure MP} \times \text{present flow rate}$$

when a point (present pressure, present flow rate) representing the present operating state represented as the present flow rate and present pressure in FIG. 2 belongs to the aforementioned region c.

On the other hand, the present horsepower calculation unit 26 obtains a rotation speed of the variable-speed motor 2 represented by a signal received from the rotation sensor 5, that is, the present flow rate and present pressure represented by a signal received from the pressure sensor 6 and then calculates the present horsepower which is a product of the present flow rate and the present pressure, and outputs this present horsepower (=present flow rate×present pressure) to the comparison unit 27. This comparison unit 27 calculates a deviation of the target horsepower and present horsepower and outputs a control signal representing this deviation to the compensatory calculation unit 28. In this compensatory calculation unit 28, compensatory calculation such as, for example, PI (proportional integral) calculation or the like is performed on the control signal, and the compensated control signal is outputted to the inverter 3 to control the rotation speed of the variable-speed motor 2 so that the present horsepower coincides with the target horsepower. That is, autonomous control is achieved based on the present pressure and present flow rate without receiving a command pressure signal or command flow rate signal from outside so that a point (present pressure, present flow rate) representing the pressure and flow rate of fluid outputted from the fixed displacement type hydraulic pump 1 is located on the target pressure-flow rate characteristic line shown in FIG. 2.

In the autonomous inverter-driven hydraulic unit of the above constitution, when a point (present pressure, present flow rate) representing the present operating state represented as the present flow rate detected by the rotation sensor 5 and the present pressure detected by the pressure sensor 6 belongs to region a in FIG. 2, the target horsepower calculation unit 25 assumes that the maximum set flow rate MV×present pressure=target horsepower. When the point (present pressure, present flow rate) representing the present operating state belongs to region b in FIG. 2, the target horsepower calculation unit 25 assumes that the maximum set horsepower=target horsepower. When the point (present pressure, present flow rate) representing the present operating state belongs to region c in FIG. 2, it is assumed that the maximum set pressure MP×present flow rate=target horsepower. The target horsepower calculation unit 25 inputs the thus calculated target horsepower to the comparison unit 27. This comparison unit 27 calculates a deviation of this target horse power and the present horsepower received from present horsepower calculation unit 26, inputs a control signal representing this deviation to the inverter 3 via the compensatory calculation unit 28 and controls a rotational number of the variable-speed motor 2 so that the present horsepower coincides with the target horsepower. Therefore, the point (present pressure, present flow rate) representing the pressure and flow rate of fluid discharged from the fixed displacement type hydraulic pump 1 is located on the target pressure-flow rate characteristic line shown in FIG. 2.

Thus, this autonomous inverter-driven hydraulic unit performs autonomous control based on the present pressure and present flow rate without receiving a command pressure signal or command flow rate signal from outside so that a point (present pressure, present flow rate) representing the pressure and flow rate of fluid discharged from the fixed displacement type hydraulic pump 1 is located on the target pressure-flow rate characteristic line shown in FIG. 2. Therefore, this autonomous inverter-driven hydraulic unit requires no input signal wire to be connected for a command pressure signal or command flow rate signal and thus the surrounding wiring is simplified.

In addition, for example, at the time of pressure keeping in region c shown in FIG. 2, the controller 11 rotates the variable-speed motor 2 at a low speed via the inverter 3 so that the fixed displacement type hydraulic pump 1 discharges a low flow rate represented by a point on the maximum pressure line MP substantially in parallel to the vertical axis (flow rate axis) and the pressure is maintained at the maximum set pressure MP with a low discharge flow rate. Therefore, since the variable-speed motor 2 and fixed displacement type hydraulic pump 1 do not need to rotate at a rotation speed higher than necessary, energy saving can be achieved with little horsepower loss and noises can be reduced. On the other hand, when a high flow rate represented by region a in FIG. 2 is required but a pressure is not required, the controller 11 rotates the variable-speed motor 2 via the inverter 3 so that the discharge pressure of the fixed displacement type hydraulic pump 1 becomes a low pressure represented by a point on the maximum flow rate line MV substantially in parallel to the horizontal axis (pressure axis). Therefore, since the variable-speed motor 2 and fixed displacement type hydraulic pump 1 do not need to rotate at a rotation speed higher than necessary, energy saving can be achieved with little horsepower loss and noises can be reduced. Also, when the maximum horsepower is required, the controller 11 rotates the variable-speed motor 2 via the inverter 3 so that a value on the maximum horsepower curve MHP is obtained.

In the above embodiment, the target horsepower is calculated based on the target pressure-flow rate characteristic line by the target horsepower calculation unit 25 of the controller 11 depending on which of regions a, b, c in FIG. 2 a point (present pressure, present flow rate) representing the present operating state is located in and then a control signal representing a deviation of the target horsepower and present horsepower is outputted from the comparison unit 27 to the inverter 3 so that the present horsepower becomes the target horsepower. Therefore, the point (present pressure, present flow rate) representing the flow rate and pressure of fluid discharged from the fixed displacement type hydraulic pump 1 can easily become a value on the target pressure-flow rate characteristic line.

Furthermore, since the power supply device is constituted by the converter 17 and power circuit 18 for the controller in this embodiment, power can be supplied to the controller 11 and inverter 3 only by connecting a power wire of an ac power supply (commercial power supply) 15 to the power supply connecting terminal 16 without connecting input signal wires for command signals and the pressure and flow rate of fluid discharged from the fixed displacement type hydraulic pump 1 can be autonomously made values on the target pressure-flow rate characteristic line in FIG. 2 based on the present pressure and present flow rate. Therefore, there is no input signal wire surrounding the autonomous inverter-driven hydraulic unit J and the surroundings becomes orderly.

In the above embodiment, the target pressure-flow rate characteristic line is composed of the maximum flow rate line, maximum horsepower curve and maximum pressure line. However, a pseudo maximum horsepower line composed of a diagonal line or polygonal line may be used instead of the maximum horsepower curve. Also, the target pressure-flow rate characteristic line may be an arbitrary curve or polygonal line which is the most preferable for operation.

Also, in the above embodiment, a target horsepower is obtained for each of regions a, b, c so that the present pressure and present flow rate become values on the target pressure-flow rate characteristic line. However, the shortest distance between a point (present pressure, present flow rate) representing the present operating state and the target pressure-flow rate characteristic line may be obtained and a product of a pressure and flow rate represented by the point on the target pressure-flow rate characteristic line which is located at the shortest distance may be made a target horsepower.

Furthermore, in the above embodiment, a pressure sensor 6 is used as a load sensor. However, a current sensor (not shown) for detecting current of the variable-speed motor 2 may be used instead of this pressure sensor. This current sensor can easily detect a pressure of discharge fluid from the fixed displacement type hydraulic pump 1 via current having a value corresponding to the pressure.

Also, in the above embodiment, the maximum set pressure, maximum set flow rate and maximum set horsepower are set by using the setting switches 21, 22, 23. However, an EEPROM or flash memory may be used to write the maximum set pressure, maximum set flow rate and maximum set horsepower therein after or before shipment.

Also, in the above embodiment, a deviation of the target horsepower and present horsepower is calculated to obtain a control signal. However, a control signal may be obtained based on a deviation of the target pressure and present pressure and a deviation of the target flow rate and present flow rate.

Also, in the above embodiment, since the ac power supply (commercial power supply) 15 is used, the power supply device includes the converter 17. However, when a dc power supply (battery) is used, the converter 17 is not required.

Also, in the above embodiment, a fixed displacement type hydraulic pump is used. However, a variable displacement type hydraulic pump, which can change the upper limit value of the flow rate, may be used.

As evident from the above, according to the autonomous inverter-driven hydraulic unit of the present invention, a control signal is outputted from the controller to the inverter based on outputs from the load sensor and rotation sensor without receiving a pressure command signal or flow rate command signal from outside so that the pressure and flow rate of fluid discharged from the hydraulic pump become the pressure and flow rate on the predetermined target pressure-flow rate characteristic line. Therefore, input signal wires can be omitted and no human operation for inputting these command signals is required since the pressure command signal and flow rate command signal do not need to be inputted from outside. Thus, wiring is simplified.

According to one embodiment, since the target pressure-flow rate characteristic line is composed of the maximum flow rate line, maximum horsepower curve or pseudo maximum horsepower line and maximum pressure line, the variable-speed motor and hydraulic pump do not need to rotate at a rotation speed higher than necessary when operation on the maximum flow rate line or maximum pressure line is performed. Therefore, energy saving can be achieved with little horsepower loss and noises can be reduced.

According to another embodiment, the target horsepower calculation unit of the controller calculates the target horsepower based on outputs from the load sensor and rotation sensor and the target pressure-low rate characteristic line without receiving command signals from outside. On the other hand, the present horsepower calculation unit calculates the present horsepower based on outputs from the load sensor and rotation sensor and the comparison unit compares the target horsepower and present horsepower and outputs a control signal to the inverter so that the present horsepower becomes the target horsepower. Therefore, the flow rate and pressure of fluid discharged from the hydraulic pump can be easily made values on the target pressure-flow rate characteristic line.

According to another embodiment, since the load sensor is a current sensor for detecting current which flows to the variable-speed motor, a discharge pressure of the hydraulic pump can be easily detected.

According to another embodiment, since the load sensor is a pressure sensor for detecting a pressure in the discharge line of the hydraulic pump, a pressure in the discharge line of the hydraulic pump can be detected directly and precisely.

What is claimed is:

1. An autonomous inverter-driven hydraulic unit comprising:

a hydraulic pump (1);

a variable-speed motor (2) for driving the hydraulic pump (1);

an inverter (3) for driving the variable-speed motor (2);

a load sensor (6) for detection a load of the hydraulic pump (1);

a rotation sensor (5) for detecting a rotation speed of the variable-speed motor (2) or hydraulic pump (1);

a controller (11) for outputting a control signal to the inverter (3) based on outputs from the load sensor (6) and rotation sensor (5) so that a pressure and flow rate of fluid discharged from the hydraulic pump (1) become a pressure and flow rate on a predetermined target pressure-flow rate characteristic line, the controller (11) having a target horsepower calculation unit (25) calculating a target horsepower based on the outputs from the load sensor (6) and rotation sensor (5) and the target pressure-flow rate characteristic line, a present horsepower calculation unit (26) calculating a present horsepower based on the outputs from the load sensor (6) and rotation sensor (5) and a comparison unit (27) comparing the target horsepower and the present horsepower and outputting the control signal to the inverter (3).

2. The autonomous inverter-driven hydraulic unit according to claim 1, wherein the target pressure-flow rate characteristic line is composed of a maximum flow rate (MV), maximum horsepower curve (MHP), and maximum pressure line (MP).

3. The autonomous inverter-driven hydraulic unit according to claim 1, wherein the load sensor is a current sensor for detecting current flowing to the variable-speed motor (2).

4. The autonomous inverter-driven hydraulic unit according to claim 1, wherein the load sensor (6) is a pressure sensor (6) for detecting a pressure in a discharge line of the hydraulic pump (1).

* * * * *